US007025172B2

(12) United States Patent
Gregory

(10) Patent No.: US 7,025,172 B2
(45) Date of Patent: Apr. 11, 2006

(54) FIXED STRAND DESCENDING AND LOWERING SYSTEM

(76) Inventor: James Gregory, P.O. Box 3374, Sedona, AZ (US) 86340

( * ) Notice: Subject to any disclaimer, the term of this patent is extended or adjusted under 35 U.S.C. 154(b) by 0 days.

(21) Appl. No.: 10/425,859

(22) Filed: Apr. 28, 2003

(65) Prior Publication Data

US 2004/0016597 A1 Jan. 29, 2004

Related U.S. Application Data

(60) Provisional application No. 60/375,987, filed on Apr. 29, 2002.

(51) Int. Cl.
*A47L 3/04* (2006.01)

(52) U.S. Cl. ..... 182/5; 182/3

(58) Field of Classification Search ..... 182/5, 182/66, 7, 8, 9, 50, 72, 3; 188/65.4
See application file for complete search history.

(56) References Cited

U.S. PATENT DOCUMENTS 312,085 A * 2/1885 Claghorn ..... 182/5
1,103,849 A * 7/1914 Stenborg ..... 188/65.2
1,351,734 A * 9/1920 Barrington ..... 182/5
3,695,397 A * 10/1972 Hobbs ..... 188/65.4
4,019,609 A * 4/1977 Wagner ..... 188/65.4
4,298,091 A * 11/1981 Anderson ..... 182/3
4,311,218 A * 1/1982 Steffen ..... 188/65.4
4,372,422 A * 2/1983 Sharp ..... 182/5
4,508,193 A * 4/1985 Forrest ..... 182/5
4,550,801 A * 11/1985 Forrest ..... 182/7
4,667,772 A * 5/1987 Kammerer ..... 182/6
4,723,634 A * 2/1988 Fisk ..... 188/65.4
5,940,943 A * 8/1999 Kloster ..... 24/588.1

* cited by examiner

*Primary Examiner*—Hugh B. Thompson, II
(74) *Attorney, Agent, or Firm*—Michael G. Petit

(57) ABSTRACT

A method for descending and/or lowering objects from a height employing a device that includes a fixed strand, a locking carabiner, and a simple harness. The carabiner serves as both a connector between the harness and the strand, and a friction device. Wrapping the strand one or more times around a side of the locking carabiner opposite its locking gate provides friction when the strand is pulled below the carabiner to apply tension thereto. This construction eliminates one component commonly used in similar systems, and results in a lowering and descending system that is lightweight, easy to use and is quick to set up and dismantle.

2 Claims, 10 Drawing Sheets

FIXED STRAND DESCENDING AND LOWERING SYSTEM

This application claims the benefit of U.S. Provisional Application No. 60/375,987, filed Apr. 29, 2003.

BACKGROUND OF THE INVENTION

1. Field of the Invention

The present invention relates to an integrated system consisting of a fixed strand, a locking carabiner and a harness operable for enabling a person to descend from a height, and for lowering a person or object from a height.

2. Prior Art

The challenge of descending safely from a height can be traced back to prehistory, where archeological evidence of broken bones indicates, amongst other causes, trauma from falls. With the advent of the Industrial Revolution, came the development of strong, reliable cordage, which made the processes of descending (wherein the person is in control of the action) and lowering (wherein the person or object has no control over the action) significantly safer. But no matter how strong the strand (being any form of rope, webbing or cable), descending hand over hand posed a significant problem due to a lack of upper body strength—most people were not strong enough to support their weight for more than a few seconds. In addition, there was still the danger of falling off the strand, because the person descending was not attached to anything. Similarly, lowering techniques typically involved either lowering objects via a simple rope with no mechanical advantage which required significant muscle power and offered little control, or an arrangement mitigated by one or more pulleys, which were heavy to transport, difficult to rig, and slow to use.

Descending and lowering systems fall into two broad categories: those that make use of a fixed strand (wherein a device slides down a stationary strand) and those that do not. Since this application is for a system that makes use of a fixed strand, emphasis has been placed on an examination of similar systems and devices.

Before 1980, fixed-strand descending devices tended to be bulky (Hunter, 1976, U.S. Pat. No. 3,949,832) and complicated (Hobbs, 1972, U.S. Pat. No. 3,695,397 and Hobbs, 1973, U.S. Pat. No. 3,757,901). In the 1970's and 80's, developments in the sport of caving revolutionized fixed-strand descending technology resulting in off-the-shelf descending gear that was lighter, stronger and easier to use. Such descending gear, which lead to the sport of rappelling (also called abseiling), typically consists of a mountain climbing grade rope, a waist harness (such as disclosed by Petzl, 1992, U.S. Pat. No. 5,145,027), a locking carabiner (an oval of hardened metal with a lockable gate) and a friction device such as some variation of the popular "figure 8", typically used for short rappels, or a brake bar (such as disclosed by Steffen, 1982, U.S. Pat. No. 4,311,218) for rappels over 200 feet. While rappelling allows the user to safely descend from height, it has a number of shortcomings. First, it is heavy. A typical rappelling configuration, consisting of a mountain climbing belt, 200 feet of 10.8 mm static mountaineering rope, a figure 8-type friction device and locking carabiner, as well as related gear, such as non-locking carabiners and webbing, weighs approximately 15 pounds. In the case of longer descents, the use of a rolling rack as a friction device instead of a "figure 8" type of device, could add an extra pound and a second belay line would add another three to five pounds. It is also bulky, and requires a large pack to carry all the rappelling gear mentioned above.

It is complicated and time consuming to rig. Rappelling is an unforgiving sport. There are strict conventions that have to be rigidly adhered to, or the procedure is not safe. Typically, two anchor points are selected, climbing-grade webbing made fast to each with a special non-slip knot, double non-locking carabiners placed on each webbing; the rope has to be looped and knotted with a special non-slip knot and affixed to all four carabiners. The harness has to be put on, buckled at the waist using a locking buckle, leg straps adjusted and tightened, rope run through the friction device, a locking carabiner must link the friction device with rope to the mountain climbing belt—all this before ever beginning the descent. Rigging a second line for the purposes of belaying (wherein a line is attached to the person descending, looped around an anchor point at height and then down to a person at a lower level who provides backup control of the descent with a second friction device) would add another level of complexity.

Rappelling equipment requires extensive training to use. The act of rappelling requires certain formal postures and procedures such as: the right hand gripping the rope in a manner that is relaxed yet firm, and simultaneously, the same right hand moving back and forth to different positions on the right hip, while at the same time, leaning far back, feet wide apart and knees locked. If any of these steps are left out, the rappeller could be at risk. With a simple belay device, such as a "figure 8", there is not much latitude in adjusting the amount of friction, other than the amount of pull on the rope. Finally, during the act of rappelling, the right hand bears all the responsibility and effort of controlling the descent; the left hand is used only for stabilizing. This requires a certain amount of strength and agility.

A system similar to conventional rappelling uses a friction device in the form of a forged aluminum shank with a rope guide and attachment holes at each end and a metal cover, whereby the cover is removed, the rope is wrapped a number of times around the shank and then the cover is replaced. Such systems are marketed under trademarks such as Sky Genie, Frost Rope Rider and Miller Descent Device. While elegant in design, they are really just variations on the conventional rappelling system with a different sort of friction device, and thus share all the same drawbacks as rappelling mentioned above. The same drawbacks also apply to descending systems that make use of hand brakes consisting of wheels, pulleys, gears, sheaves and like mechanisms such as Rogelja, 1994, U.S. Pat. No. 4,596,314.

The prior art of fixed strand fire escape and evacuation systems suffers from the same drawbacks as the rappelling systems outlined above, namely: they are bulky (Sheppard, 1977, U.S. Pat. No. 4,024,927), and complicated (Green et al., 1990, U.S. Pat. No. 4,934,484 and Varner et al., 1991, U.S. Pat. No. 5,038,888). In addition, most are made with unrated materials (Budd, 1888, U.S. Pat. No. 386,237) or are potentially unsafe (such as the web-on-web design of Walker Sr., 1986, U.S. Pat. No. 4,588,045), and for that reason have questionable safety margins.

The device disclosed by Wood, 1982, U.S. Pat. No. 4,311,217 is one of only a few devices dedicated to lowering a person or object on a fixed rope. While it is elegant and compact, it suffers from the drawback of having a number of pins and hinges which add to the complexity of the design and are points of potential failure. The lack of prior art of fixed-strand lowering systems is in part due to the fact that the use of a fixed strand is not the conventional method of lowering—moveable strands with spools and pulleys are more the norm. Another reason is that some fixed-strand descending devices, such as Sky Genie, Frost Rope Rider and Miller Descent Device mentioned above, can also double as lowering devices. A drawback of such devices is that they consist of a number of components making them bulky and complicated to rig.

SUMMARY

Several objects and advantages of my invention are:

(a) to provide a descending and lowering system that is simple in design and construction;

(b) to provide a descending system that is easy to learn and use;

(c) to provide a descending and lowering system that is lightweight and compact;

(d) to provide a descending system that is quick to rig in an emergency;

(e) to provide a descending and lowering system that does not require any particular skill or physical strength;

(f) to provide a descending and lowering system that feels secure and comfortable.

Further objects and advantages are to provide a descending and lowering system that can easily fit into a side pocket of a hiking pack or the trunk of a police car; to provide a rapid method to descend from a hovering aircraft such as a helicopter or balloon; and to provide a descending and lowering system that, with the addition of lightweight ascending devices, can also be used as a lightweight ascending system. The features of the invention believed to be novel are set forth with particularity in the appended claims. However the invention itself, both as to organization and method of operation, together with further objects and advantages thereof may be best understood by reference to the following description taken in conjunction with the accompanying drawings.

BRIEF DESCRIPTION OF THE DRAWINGS

In the drawings, closely related figures have the same number but different alphabetic suffixes.

DRAWINGS—REFERENCE NUMERALS

Figure 1A:
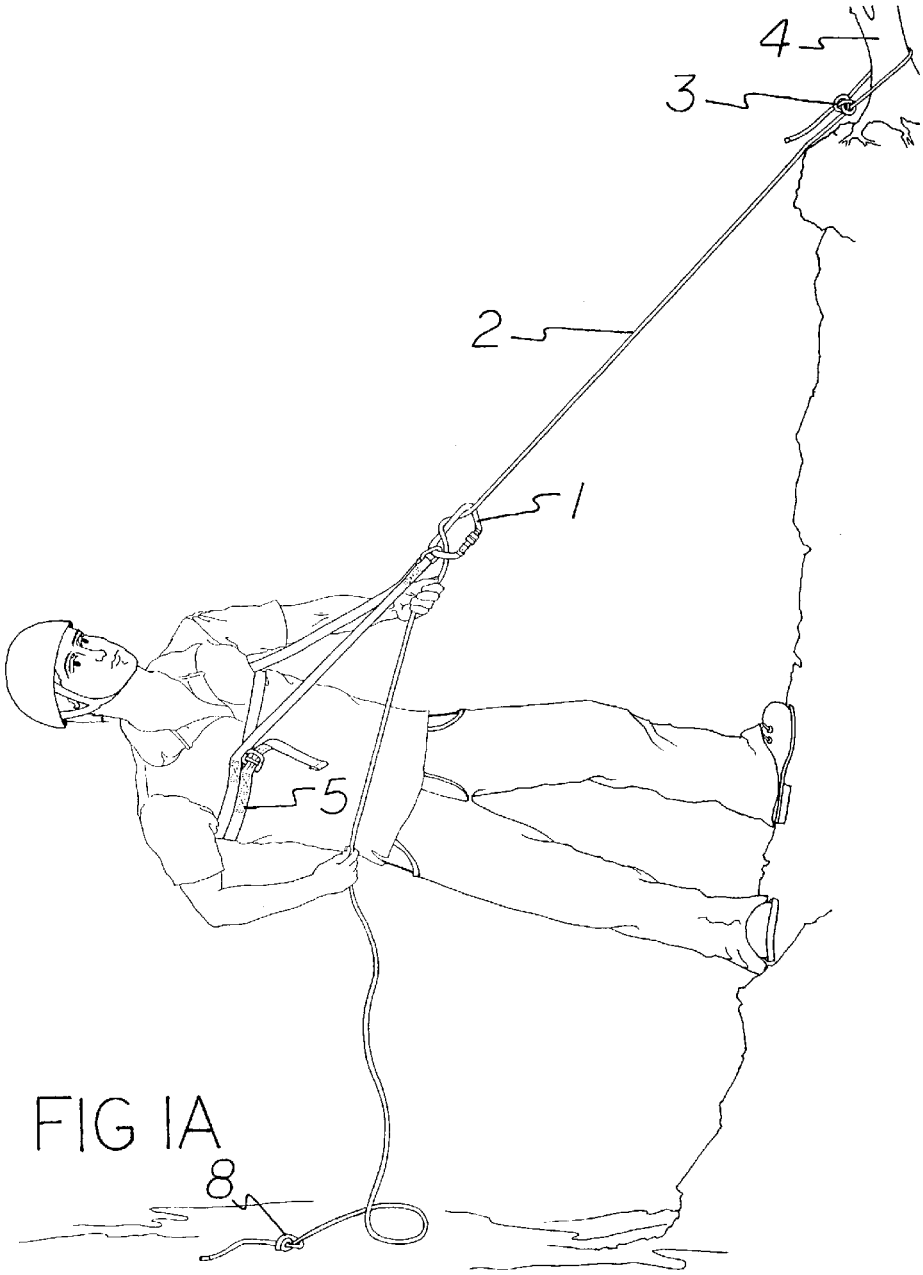
FIGS. 1A and 1B show interrelation of the different components of the invention as it used for descending in the configuration of a chest harness, a single wrap of a single rope on a single locking carabiner.

1 locking carabiner
2 strand
3 knot in strand at anchor point
4 anchor point
5 chest harness
6 rated D-ring
7 locking buckle
8 knot at end of strand
10 locking gate
11 side of carabiner opposite locking gate
12 harness strap
13 double strand
14 webbing
15 rated O-ring
20 wrist harness
21 rated metal loop
22 ankle harness
23 stretcher
24 cargo harness

DESCRIPTION OF THE PREFERRED EMBODIMENTS

Figure 1B:
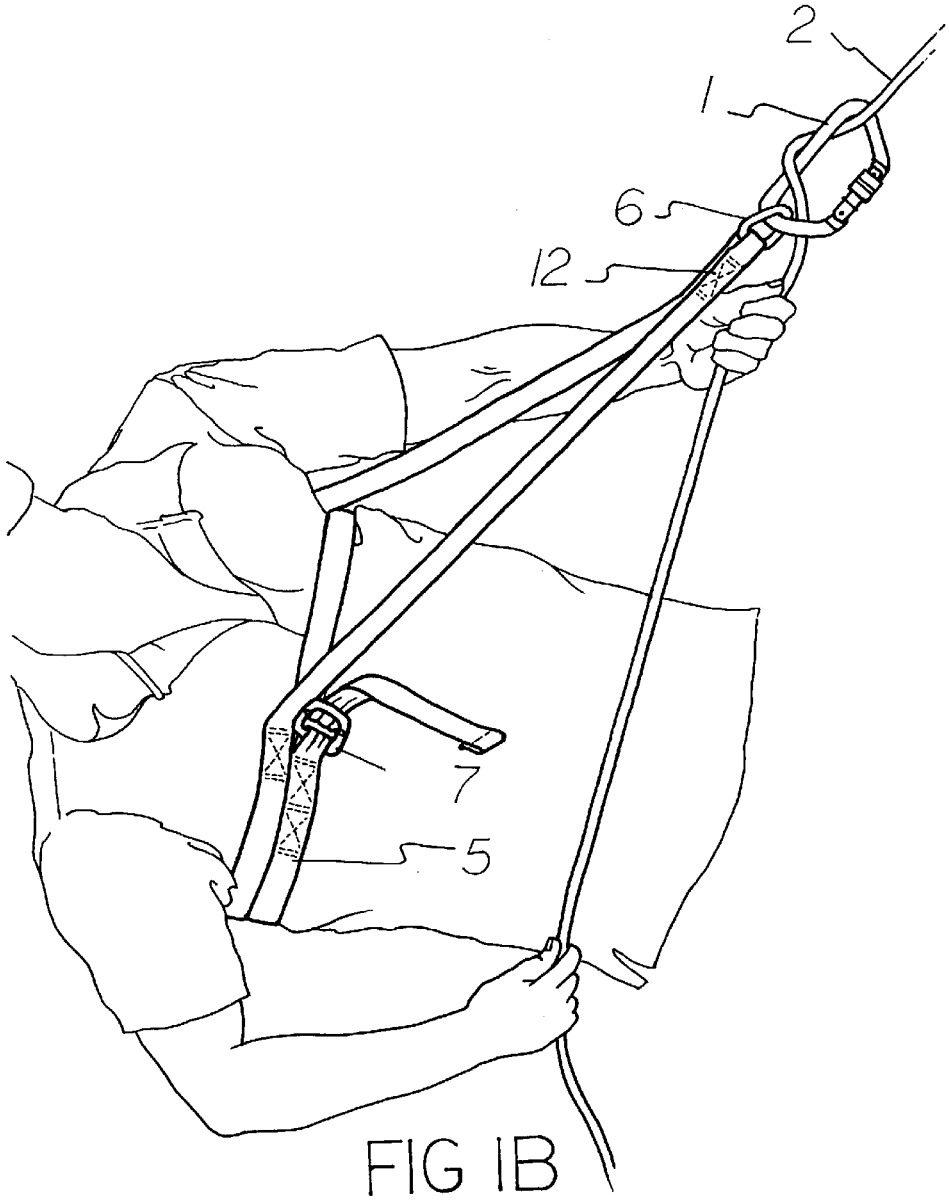

A preferred embodiment of the invention is illustrated in FIG. 1A and FIG. 1B. This descending system consists of three components: a strand 2 (in this case, a rope), a locking carabiner 1, a chest harness 5, and a locking buckle 7. The strand 2 is fixed to, or doubled around, an anchor point 4 at height, and does not move during the descending procedure. Thus, this invention is said to make use of a "fixed" strand. The recommended type of strand is 7 mm mountaineering grade rope; if this invention is to be used as a fire escape system, a fire resistant strand should be used.

The carabiner 1, which doubles as a friction device, can be any off-the-shelf model, where one rated for fall protection with a large size and circular cross section is recommended. A non-locking carabiner is unsafe in this application and must not be used. The chest harness 5 shares the following characteristics with all harnesses uniquely designed to be used as part of this system:

Lightweight

Constructed of one continuous piece of mountaineering-grade webbing

Sewn on an industrial sewing machine using nylon thread and lock stitches

All buckles and D-rings rated

Figure 4:
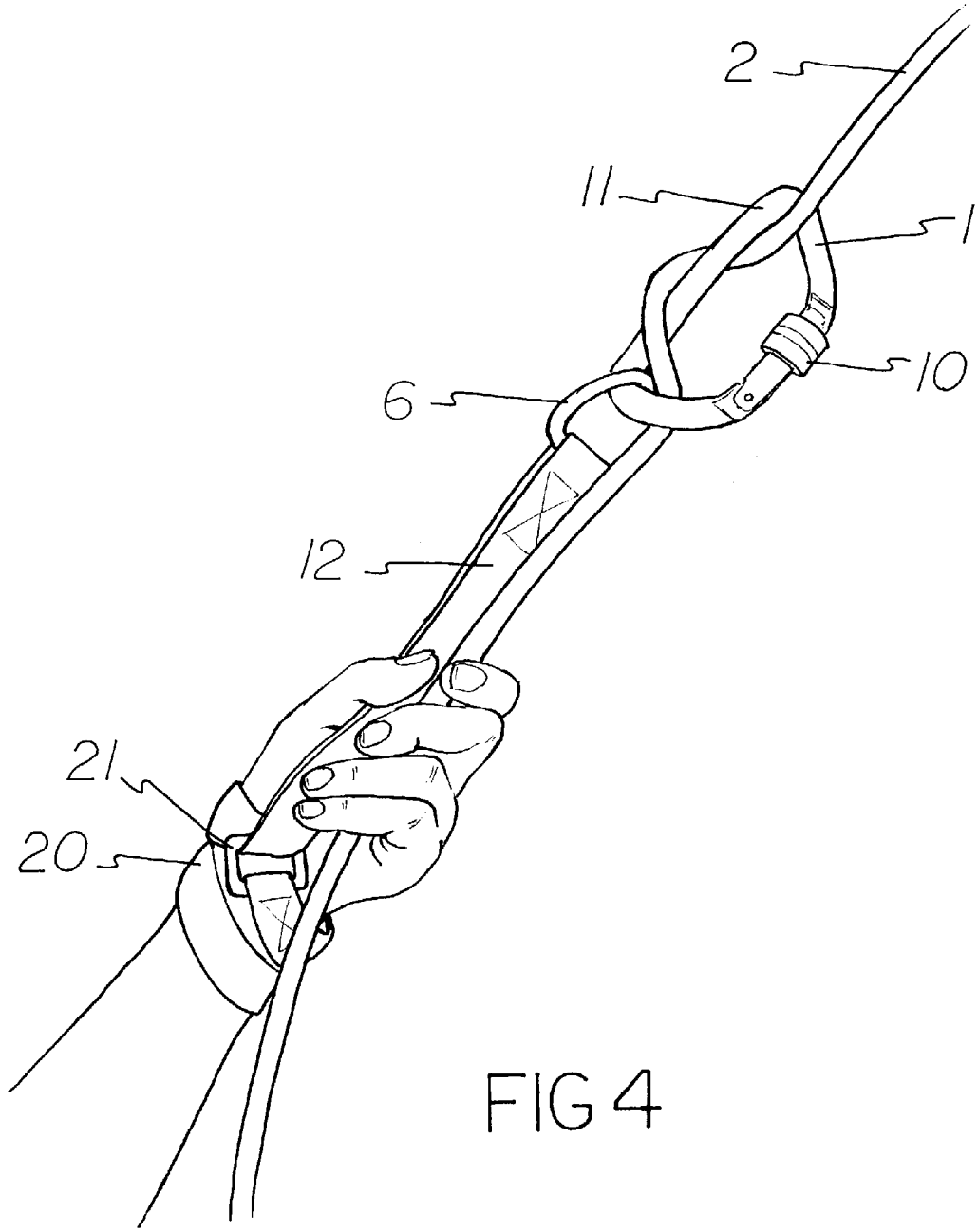
FIG. 4 shows a wrist harness configured with a single wrap of a single rope on a single locking carabiner.
Figure 6:
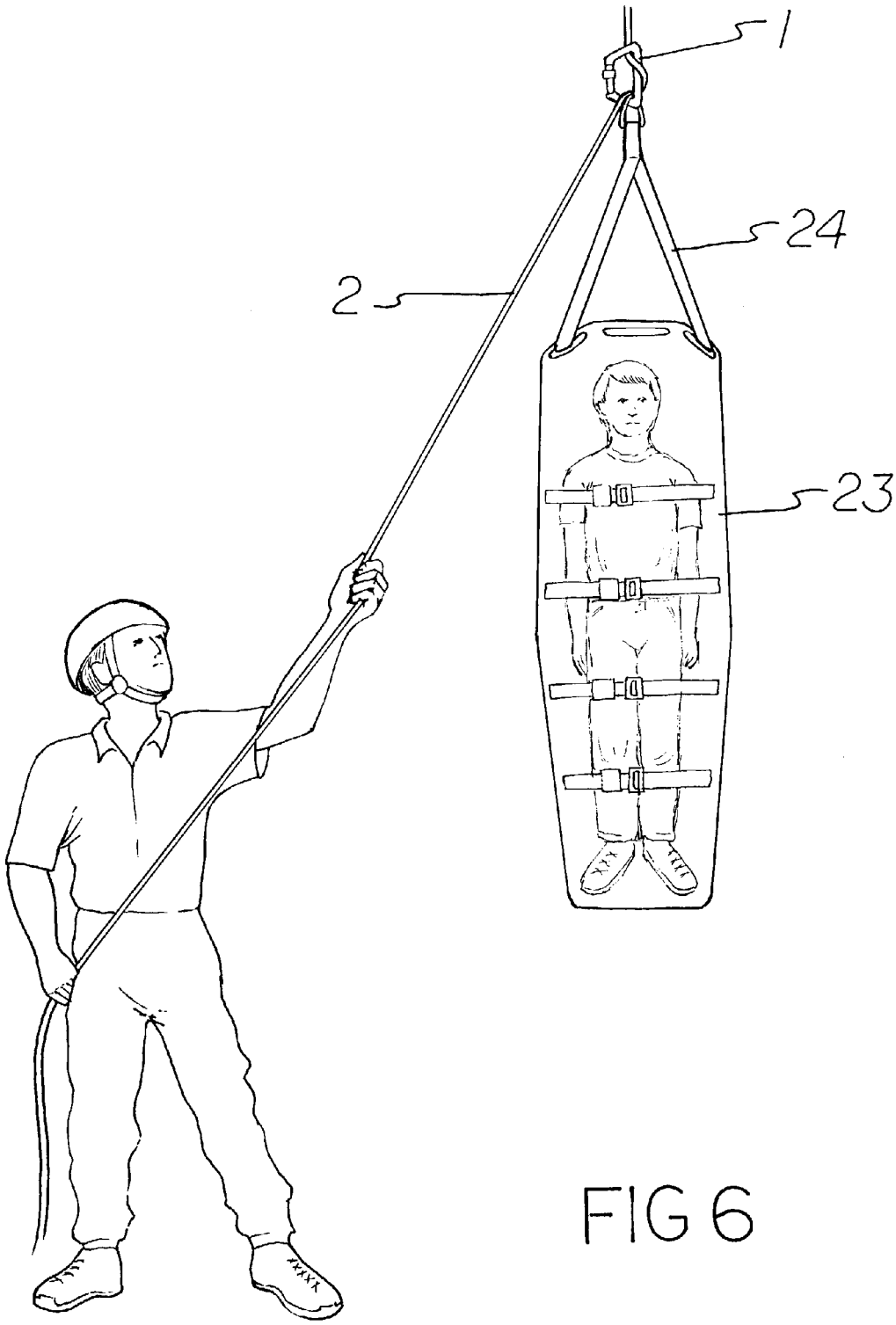
FIG. 6 shows a person affixed to a stretcher being lowered with the configuration of a single wrap of a single rope on a single locking carabiner.

A double strap of webbing 12 terminating in a rated D-ring 6 connecting said harness to said carabiner Additional Embodiments In addition to the system being used to descend with a chest harness, as mentioned above, another useful configuration of the system is to descend using a wrist harness 20 having a rated metal loop 21, as indicated in FIG. 4. The system can be used to a lower person or object such as a stretcher 23 from height, whereby a person holding on to the strand anywhere below, as indicated in FIG. 6 controls the rate of descent.

With the addition of one or two "ascenders" (mountain climbing gear which slides easily along a rope in one direction, but locks or jams in the other), this system can also be used to climb ropes as well as to descend them. One such ascender, called "Tibloc" made by Petzl, weighs only one ounce each and is a natural complement to this lightweight descending system.

In the event that a person descending using this system is at risk of a catastrophic fall due to injury (such as from a rock falling from above) or panic (by their letting go of said strand), a person at some point below them by pulling on said strand could at first stop the person from falling, and then lower them safely to the ground. This is a technique known as "belaying from below."

Alternative Embodiments

Figure 5:
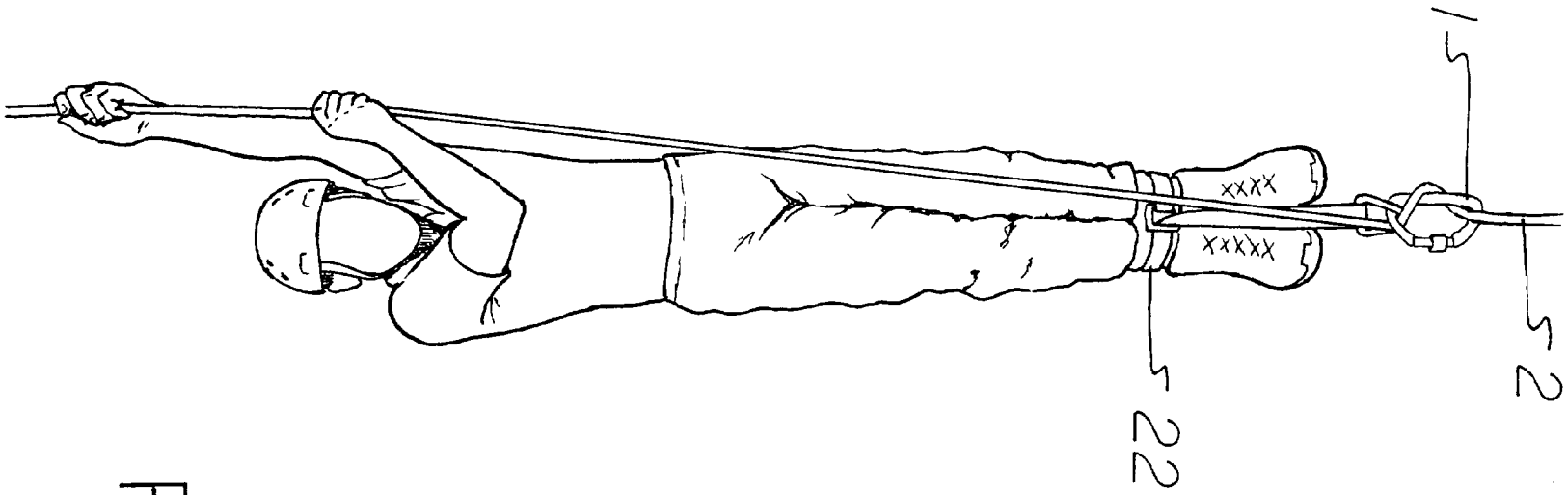
FIG. 5 shows a person descending with an ankle harness configured with a single wrap of a single rope on a single locking carabiner.

In addition to the applications stated above, there are a number of other uses for this descending and lowering system. In certain confined spaces where precise control of a high-angle descent is essential, this system is ideal when a person is rigged with a harness securely fastened to one or both ankles 22, as indicated in FIG. 5.

Figure 2A:
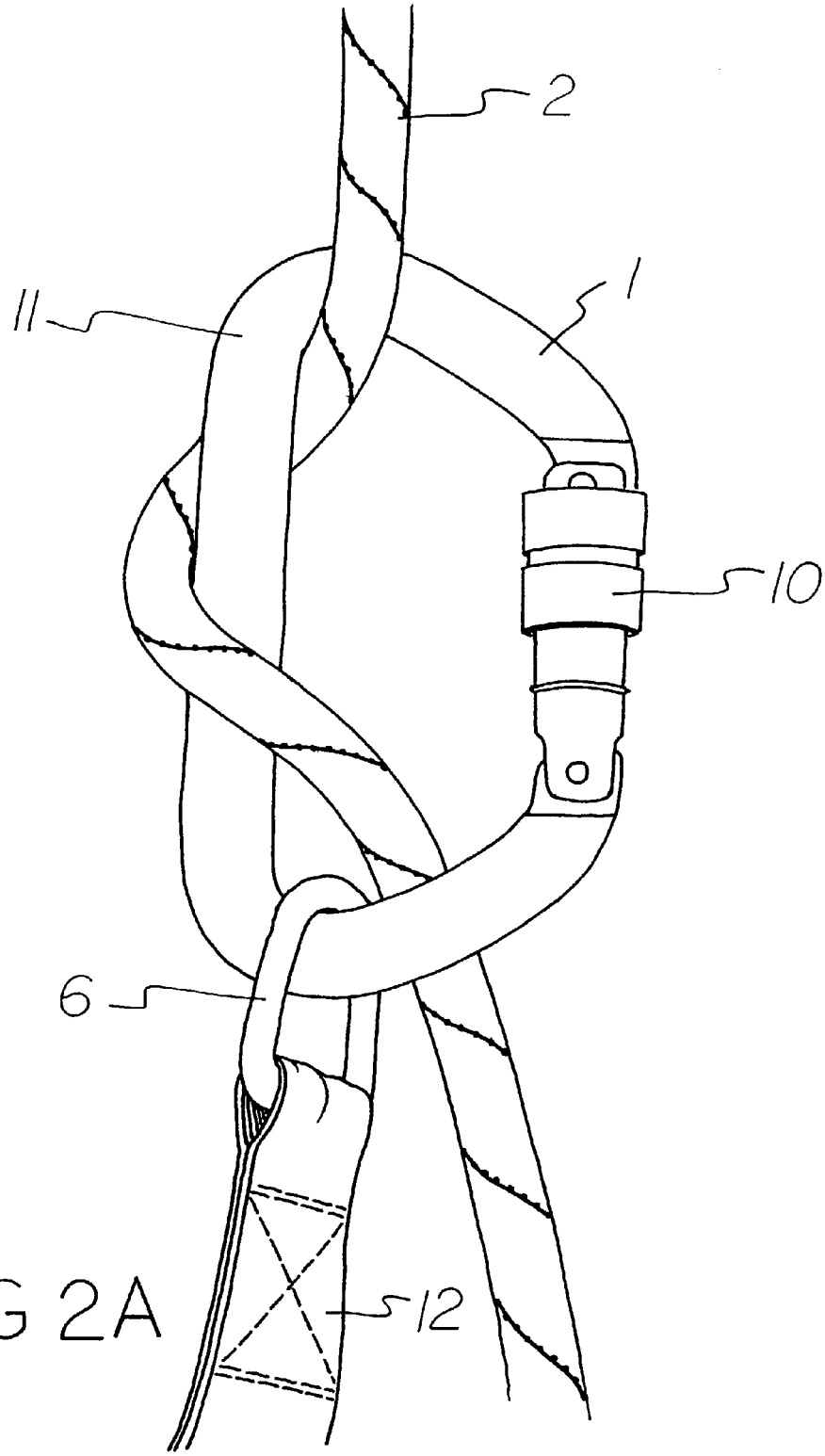
FIGS. 2A through 2D show different configurations of strands and wraps on a single locking carabiner.
Figure 2B:
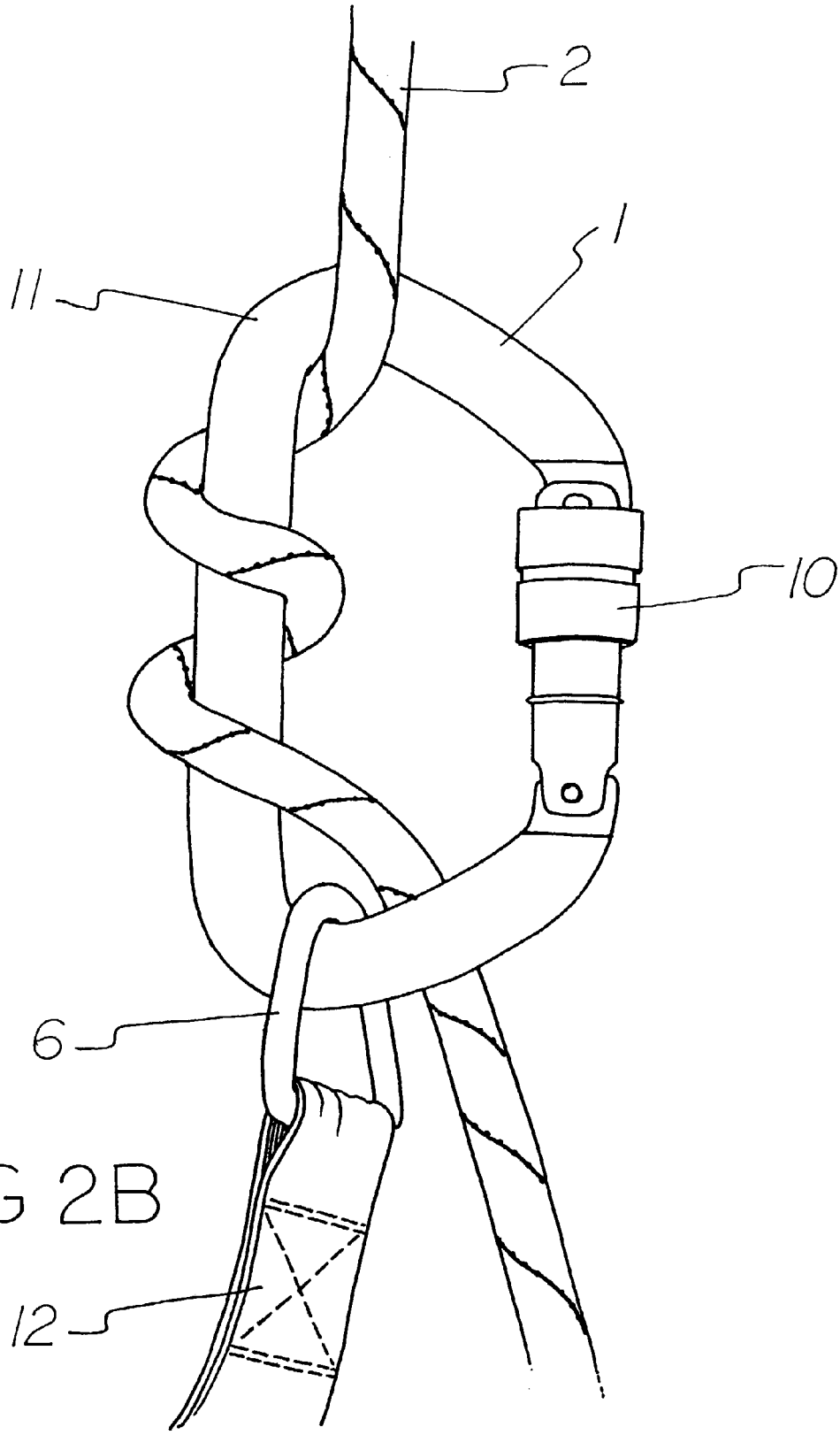
Figure 2C:
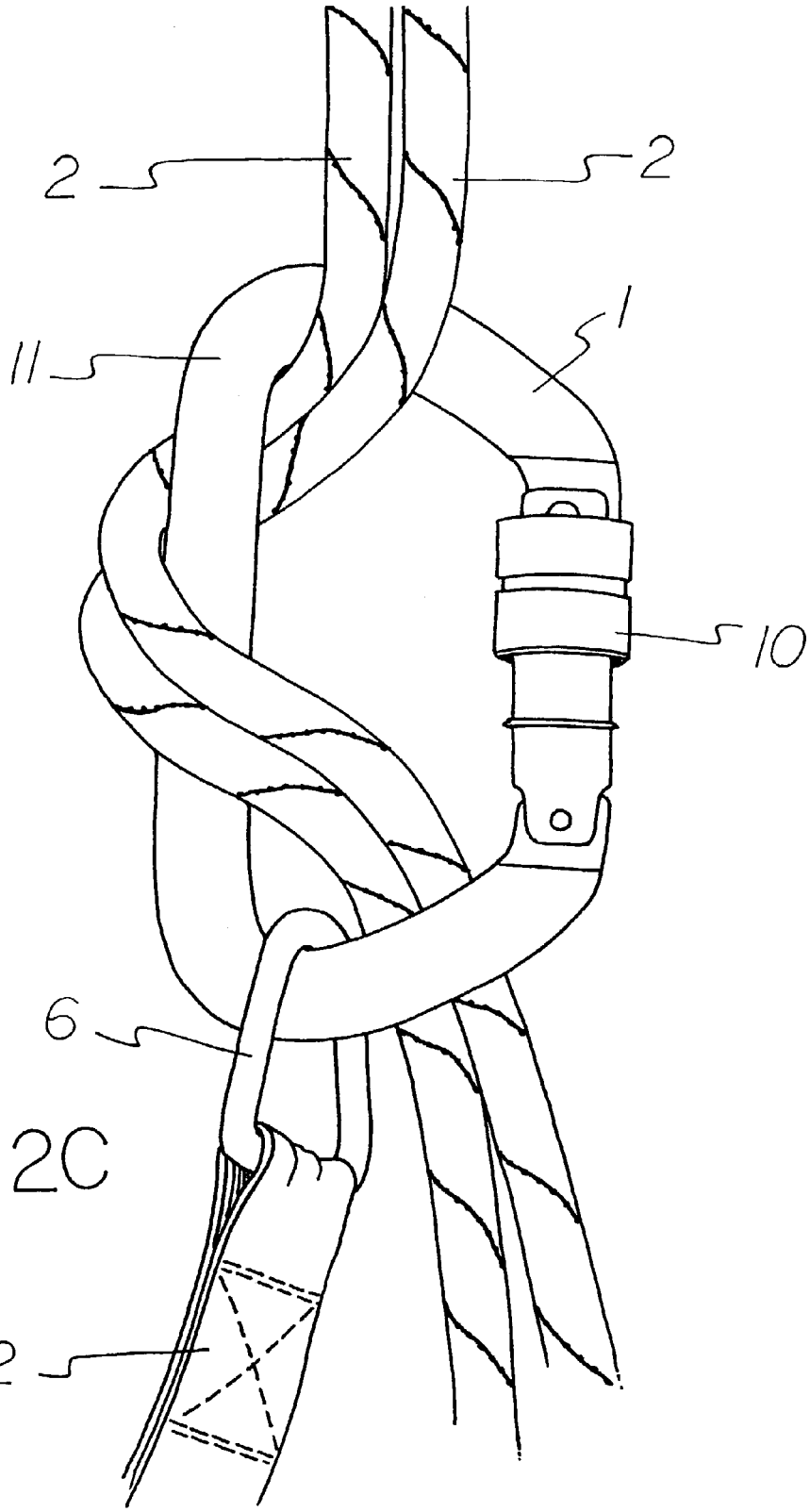
Figure 2D:
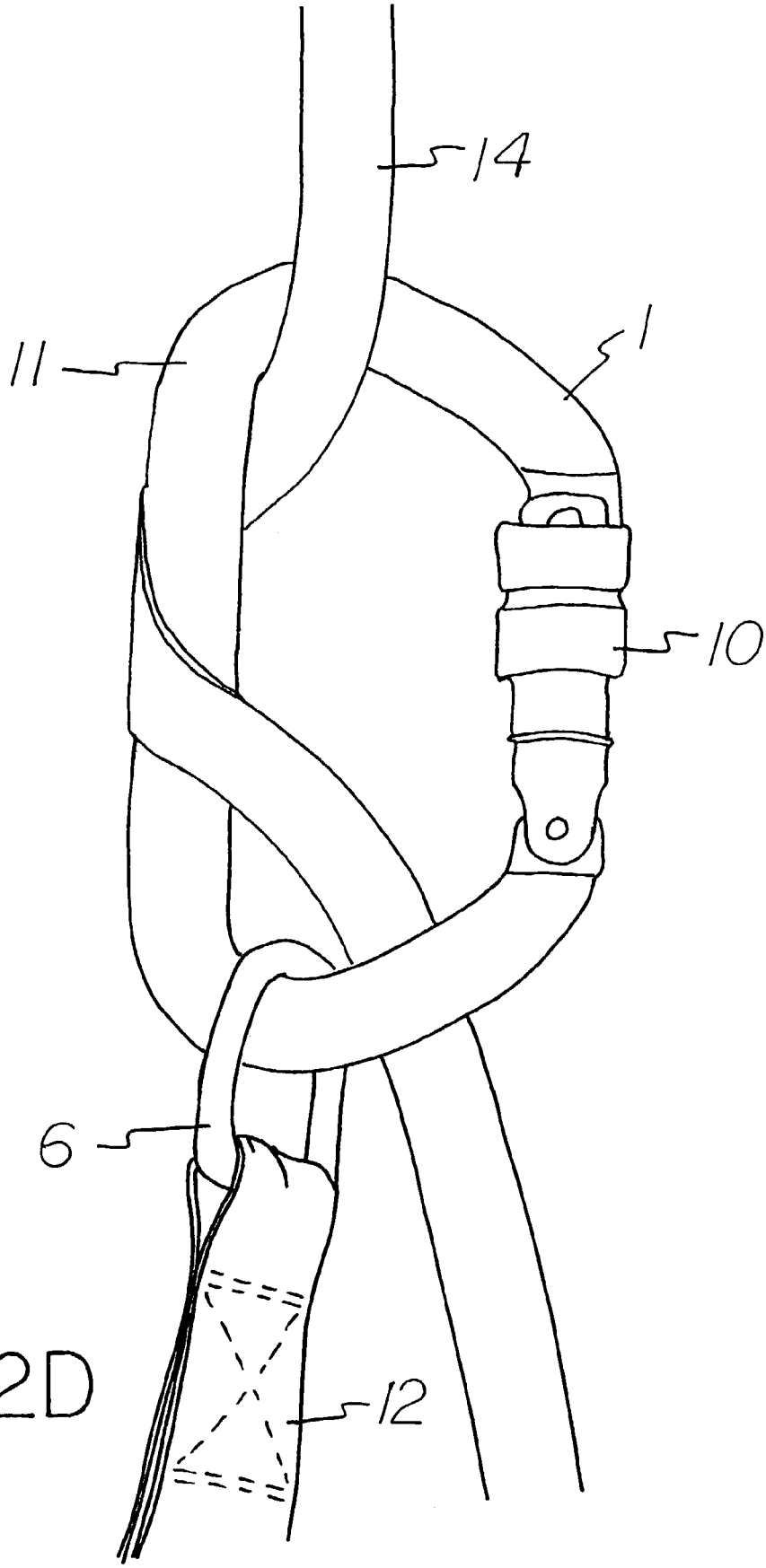

This descending system is particularly forgiving, to the point that there is only one rule: Never let go of the rope! Because of this, the system supports a variety of variations and options:

- Multiple descending techniques, such as, but not limited to: two hands forward on strand; one hand forward, one hand back on strand; only one hand on strand; facing up the strand; facing down the strand; strand on left; strand on right.
- A wide variety of types of strands, such as, but not limited to: any thickness of a single rope (FIG. 2A) up to 1 inch, a doubled rope (FIG. 2C), webbing 14 (FIG. 2D).
- Joined strands, due to the open nature of the large locking carabiner used as a friction device, which allows knots in the strand to pass through easily and without binding.

Figure 3:
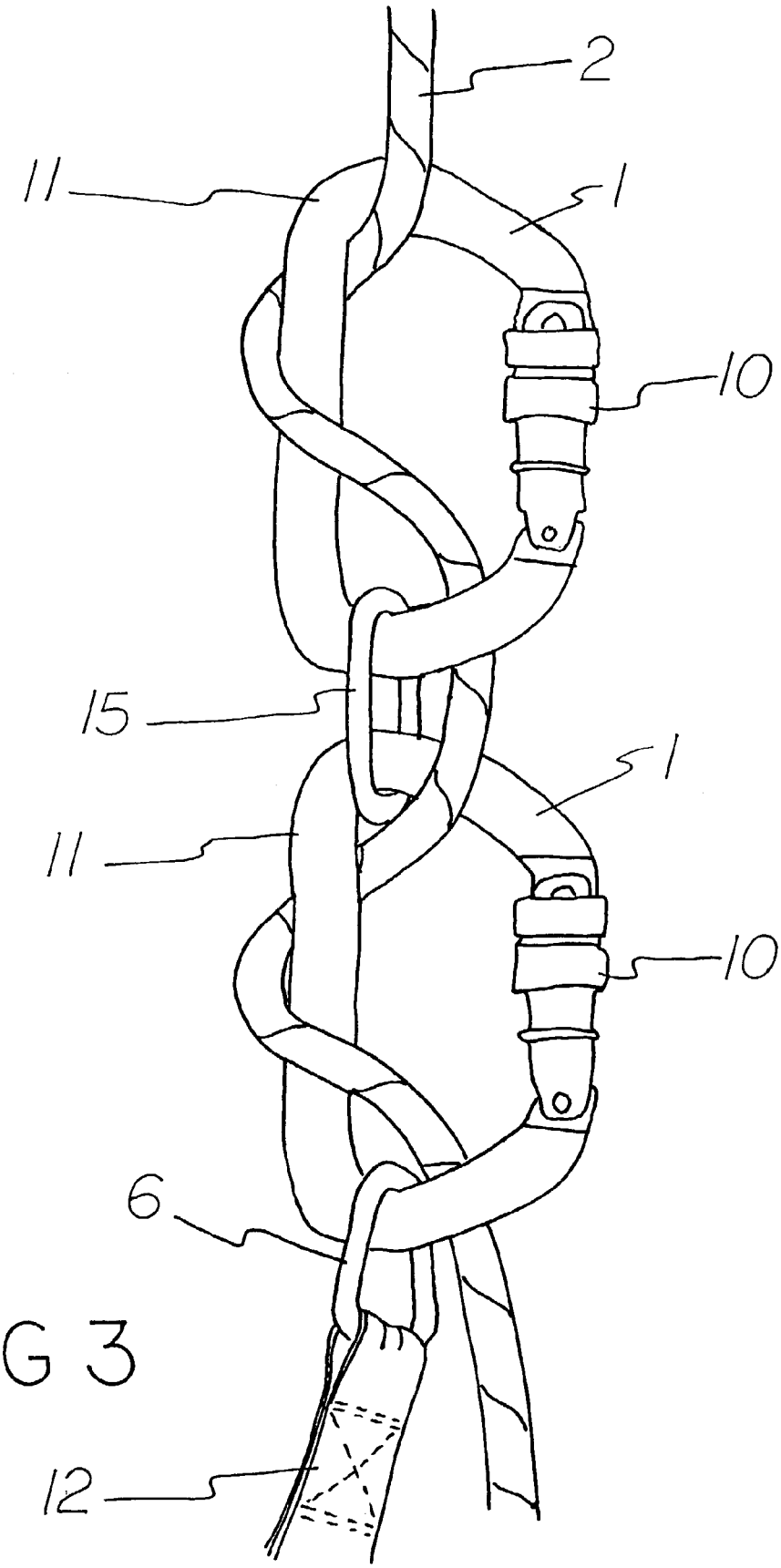
FIG. 3 shows a single wrap of a single rope on two carabiners in series linked by an O-ring.

In the case of lowering extremely heavy loads, this system could make use of a series of locking carabiners linked by rated O-rings 15 as a heavy-duty friction device, as indicated in FIG. 3.

This system could be used to descend from hovering aircraft, such as, but not limited to, helicopters and hot air balloons. Similarly, this system could be used to lower objects or persons from hovering aircraft, such as, but not limited to, helicopters and hot air balloons.

Operation

This invention has two purposes: to descend from a height and to lower an object or a person from a height. Using this invention, descending from a height is accomplished by the following steps:

- Select a reliable anchor point 4 at height. Rig a strand 2 to said reliable anchor point either with a knot 3 in said strand, or simply looped around it, if said strand is to be recovered from below after the descent.
- Tie a second knot 8 in the loose end(s) of said strand and throw said loose end(s) down from height, making sure said strand reaches the bottom.
- Depending on method of use, put on a chest harness 5, wrist harness 20 or ankle harness 22. Secure said harness snugly with a locking buckle.
- Take a locking carabiner 1 and wrap said strand once or twice around side of said locking carabiner 11 opposite its locking gate 10, depending on the amount of friction desired—the more wraps, the more friction.
- Insert rated D-ring 6 of said harness into said carabiner.
- Lock said carabiner.
- Descend from height with one or both hands on said strand below said carabiner. Pulling on said strand below said carabiner increases friction at said carabiner and controls rate of descent.
- At bottom, disconnect said carabiner from said harness.
- If said strand is to be used to descend at another location, recover said strand by pulling down one side.

Using this invention, lowering an object or a person from a height is accomplished by the following steps:

- Select a reliable anchor point 4 at height. Rig a strand 2 to said reliable anchor point either with a knot 3 in said strand, or simply looped around it, if said strand is to be recovered from below.
- Tie a second knot 8 in the loose end(s) of said strand and throw said loose end(s) down from height, making sure said strand reaches the bottom.
- Attach a cargo harness 24 to said object or said person to be lowered.
- Take a locking carabiner 1 and wrap said strand once or twice around side II of said carabiner opposite its locking gate 10, depending on the amount of friction desired—the more wraps, the more friction.
- Insert D-ring 6 of said harness into said carabiner.
- Lock said carabiner.
- Lower said object or said person. Rate of lowering is controlled from below—pulling on said strand by a person located at a lower height increases friction at said carabiner and slows or stops said object or said person.
- At bottom, disconnect said carabiner from said harness.
- If said strand is to be used to lower a person or object at another location, recover said strand by pulling down one side.

Advantages

From the description presented above, a number of advantages of my fixed rope descending and lowering system become evident:

(a) With no moving parts, there is little that can break or go wrong, and therefore it is safer than more complicated systems.

(b) With only three components, it is easier to learn and use.

(c) With only three components, it is lighter and more compact than other systems that require more components.

(d) With only three components, it is faster to set up than other systems that require more components, and with only one pre-rigged buckle to secure, the harness component can be put on more quickly. This is particularly important when the system used to escape a fire or evacuate a building.

(e) With a variable number of wraps on the friction device, and with two hands instead of one pulling on the strand, the act of descending requires little physical strength.

(f) With a variable number of carabiners in series as friction devices, and with a variable number of wraps on the friction devices, the amount of weight that can be lowered is limited only by the strength of an anchor point, a strand, and carabiners, but is not a function of the physical strength of a person pulling on said strand.

(g) Whether a person descends with this system using a chest harness, wrist harness or ankle harness, the high center of gravity makes said person feel more stable and secure.

(h) With no groin straps, this descending system is more comfortable than conventional mountain climbing harnesses.

CONCLUSIONS, RAMIFICATIONS AND SCOPE

In view of the foregoing description of the preferred embodiments and operation of the device, the skilled artisan will see that the invention provides a safe, lightweight, easy-to-use method system of descending from height and lowering objects and persons from height. Furthermore, this descending and lowering system has the additional advantages in that:

- it has no moving parts, so there is little to go wrong;
- it has fewer components than similar systems, so it is faster to set up and take down;
- it has multiple friction settings, so it does not require much strength to use;

it is very forgiving, supporting a variety of strands and techniques;

it is comfortable and secure.

While particular embodiments of the present invention have been illustrated and described, it would be obvious to those skilled in the art that various other changes and modifications can be made without departing from the spirit and scope of the invention. For example, it could be used to descend from hovering aircraft such as a helicopter or hot air balloon, and as a fire escape system. It is therefore intended to cover in the appended claims all such changes and modifications that are within the scope of this invention.

What I claim is:

1. A method for a person to descend from a height consisting of the following steps:

a. fixing a strand to an anchor point at the height;

b. attaching a harness to the person who is to descend from the height;

c. wrapping said strand one of either once and twice around a side of a locking carabiner having a locking gate, said side being opposite said locking gate, wherein the number of wraps determines an amount of friction; then d. clipping said carabiner on to said harness by way of a D-ring at the end of the harness; then e. locking said carabiner; then f. descending from height while holding on to said strand with one or both hands below said carabiner, an amount of pull on said strand below said carabiner defining a tension and determining the rate of descent, the rate of descent depending on the tension applied to the strand.

2. A method for lowering an object or person from a height consisting of the following steps:

a. fixing a strand to an anchor point disposed at the height; and b. attaching a harness to an object or a person to be lowered; and c. wrapping said strand one of either once and twice around a side of a locking carabiner having a locking gate, said side being opposite to said locking gate, wherein the number of wraps determines an amount of friction; and d. clipping said carabiner onto said harness by way of a D-ring affixed to said harness; and e. locking said carabiner, and f. grasping said strand at some location below said carabiner and applying a tension thereto; and g. lowering said object or said person from height, whereby the tension applied to said strand below said carabiner determines the rate of lowering, and wherein the greater the tension applied to the strand, the slower the rate of descent.

* * * * *